US008048834B2

(12) United States Patent
Guinther et al.

(10) Patent No.: US 8,048,834 B2
(45) **Date of Patent: *Nov. 1, 2011**

(54) ADDITIVES AND LUBRICANT FORMULATIONS FOR IMPROVED CATALYST PERFORMANCE

(75) Inventors: Gregory H. Guinther, Richmond, VA (US); John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 217 days.

This patent is subject to a terminal disclaimer.

(21) Appl. No.: 11/856,422

(22) Filed: Sep. 17, 2007

(65) Prior Publication Data

US 2008/0280796 A1 Nov. 13, 2008

Related U.S. Application Data

(63) Continuation-in-part of application No. 11/745,803, filed on May 8, 2007.

(51) Int. Cl.
*C10M 137/10* (2006.01)

(52) U.S. Cl. ..... 508/369; 508/110; 508/364

(58) Field of Classification Search ..... 508/418, 508/421, 364, 110, 369, 539

See application file for complete search history.

(56) References Cited

U.S. PATENT DOCUMENTS

| | | | | |
|---|---|---|---|---|
| 2,384,577 | A | | 9/1945 | Thomas |
| 2,710,872 | A | | 6/1955 | Thompson |
| 2,786,866 | A | | 3/1957 | Hook et al. |
| 2,897,152 | A | | 7/1959 | Elliott et al. |
| 3,219,666 | A | | 11/1965 | Norman et al. |
| 3,356,702 | A | | 12/1967 | Farmer et al. |
| 3,407,222 | A | | 10/1968 | Lies |
| 3,429,820 | A | * | 2/1969 | Wisner, Jr et al. ..... 252/78.3 |
| 3,509,051 | A | | 4/1970 | Farmer et al. |
| 3,565,804 | A | | 2/1971 | Honnen et al. |
| 3,697,574 | A | | 10/1972 | Piasek et al. |
| 3,736,357 | A | | 5/1973 | Piesek et al. |
| 3,794,081 | A | | 2/1974 | Fiser et al. |
| 3,867,359 | A | | 2/1975 | Beadle |
| 4,029,587 | A | | 6/1977 | Koch |
| 4,098,705 | A | | 7/1978 | Sakurai et al. |
| 4,164,473 | A | | 8/1979 | Coupland et al. |
| 4,178,258 | A | | 12/1979 | Papay et al. |
| 4,234,435 | A | | 11/1980 | Meinhardt et al. |
| 4,259,195 | A | | 3/1981 | King et al. |
| 4,261,843 | A | | 4/1981 | King et al. |
| 4,263,152 | A | | 4/1981 | King et al. |

(Continued)

FOREIGN PATENT DOCUMENTS

| | | |
|---|---|---|
| EP | 0330522 A2 | 8/1989 |

(Continued)

*Primary Examiner* — Michael Marcheschi
*Assistant Examiner* — Latosha Hines
(74) *Attorney, Agent, or Firm* — Luedeka, Neely & Graham, P.C.

(57) ABSTRACT

A method and compositions for lubricating surfaces with lubricating oils exhibiting increased phosphorous retention. The lubricated surface includes a lubricant composition containing a base oil of lubricating viscosity, an amount of a phosphorus-containing compound and an amount of at least one hydrocarbon soluble titanium compound that is effective to provide an aged catalyst temperature that converts at least fifty percent of exhaust gas hydrocarbons, carbon monoxide, and $NO_x$ that is lower than an aged catalyst temperature that converts at least fifty percent of exhaust gas hydrocarbons, carbon monoxide, and $NO_x$ of the lubricant composition devoid of the hydrocarbon soluble titanium compound.

25 Claims, 1 Drawing Sheet

U.S. PATENT DOCUMENTS

| | | | | |
|---|---|---|---|---|
| 4,265,773 | A | 5/1981 | De Vries et al. | |
| 4,266,945 | A | 5/1981 | Karn | |
| 4,272,387 | A | 6/1981 | King et al. | |
| 4,283,295 | A | 8/1981 | De Vries et al. | |
| 4,285,822 | A | 8/1981 | De Vries et al. | |
| 4,362,633 | A | 12/1982 | Spence et al. | |
| 4,369,119 | A | 1/1983 | De Vries et al. | |
| 4,395,343 | A | 7/1983 | De Vries et al. | |
| 4,402,840 | A | 9/1983 | De Vries et al. | |
| 4,466,901 | A | 8/1984 | Hunt et al. | |
| 4,636,322 | A | 1/1987 | Nalesnik | |
| 4,692,256 | A | 9/1987 | Umemura et al. | |
| 4,758,362 | A | 7/1988 | Butke | |
| 4,765,918 | A | 8/1988 | Love et al. | |
| 4,867,890 | A | 9/1989 | Colclough et al. | |
| 4,876,375 | A | 10/1989 | Lam | |
| 4,885,365 | A | 12/1989 | Lam | |
| 4,889,647 | A | 12/1989 | Rowan et al. | |
| 4,927,552 | A | 5/1990 | Lam | |
| 4,957,643 | A | 9/1990 | Lam | |
| 4,966,719 | A | 10/1990 | Coyle et al. | |
| 4,978,464 | A | 12/1990 | Coyle et al. | |
| 4,990,271 | A | 2/1991 | Francis | |
| 4,995,996 | A | 2/1991 | Coyle et al. | |
| 5,137,647 | A | 8/1992 | Karol | |
| 5,204,012 | A | 4/1993 | Schaffhausen | |
| 5,260,466 | A | 11/1993 | McGibbon | |
| 5,412,130 | A | 5/1995 | Karol | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,652,201 | A * | 7/1997 | Papay et al. | 508/228 |
| 5,686,397 | A | 11/1997 | Baranski et al. | |
| 5,693,598 | A | 12/1997 | Abraham et al. | |
| 5,789,357 | A | 8/1998 | Baranski et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,902,776 | A | 5/1999 | Dohner et al. | |
| 5,936,041 | A | 8/1999 | Diana et al. | |
| 6,034,040 | A | 3/2000 | Ozabalik et al. | |
| 6,103,674 | A | 8/2000 | Nalesnik et al. | |
| 6,117,826 | A | 9/2000 | Baranski et al. | |
| 6,232,276 | B1 | 5/2001 | Stiefel et al. | |
| 6,268,316 | B1 * | 7/2001 | Tanaka et al. | 508/291 |
| 6,509,303 | B1 | 1/2003 | Gatto | |
| 6,528,463 | B1 | 3/2003 | Gatto et al. | |
| 6,797,677 | B2 | 9/2004 | Esche, Jr. et al. | |
| 7,696,137 | B2 | 4/2010 | Yagishita | |
| 2002/0022272 | A1 * | 2/2002 | Kumar et al. | 436/37 |
| 2004/0266630 | A1 | 12/2004 | George et al. | |
| 2006/0014651 | A1 | 1/2006 | Esche et al. | |
| 2006/0025313 | A1 * | 2/2006 | Boffa | 508/199 |
| 2006/0205615 | A1 | 9/2006 | Esche | |
| 2006/0217271 | A1 | 9/2006 | Brown et al. | |
| 2007/0111907 | A1 * | 5/2007 | Esche et al. | 508/364 |
| 2007/0111908 | A1 * | 5/2007 | Lam et al. | 508/418 |
| 2007/0132274 | A1 | 6/2007 | Lam et al. | |
| 2008/0125336 | A1 * | 5/2008 | Loper et al. | 508/364 |

FOREIGN PATENT DOCUMENTS

| | | | |
|---|---|---|---|
| JP | 03190997 | A | 8/1991 |
| JP | 10259392 | A | 9/1998 |
| JP | 11131084 | A | 5/1999 |
| JP | 2004182829 | A | 7/2004 |
| SU | 1669975 | A | 8/1991 |
| SU | 1669976 | A | 8/1991 |

* cited by examiner

ADDITIVES AND LUBRICANT FORMULATIONS FOR IMPROVED CATALYST PERFORMANCE

RELATED APPLICATIONS

This application is a continuation-in-part of application Ser. No. 11/745,803, filed May 8, 2007, now pending.

TECHNICAL FIELD

The embodiments described herein relate to particular oil soluble metal additives and use of such metal additives in lubricating oil formulations, and in particular to soluble titanium additives used to improve exhaust catalyst performance properties.

BACKGROUND AND SUMMARY

For over fifty (50) years automotive engine oils have been formulated with zinc dialkyl dithiophosphate (ZDDP) resulting in low levels of wear, oxidation, and corrosion. The additive is truly ubiquitous and found in nearly every modern engine oil. ZDDP imparts multifunctional performance in the areas of anti-wear, anti-oxidation, and anti-corrosion and is undeniably one of the most cost-effective additives in general use by engine oil manufacturers and marketers.

However, there is concern that phosphorus from engine oils may volatilize and pass through the combustion chamber so that elemental phosphorus is deposited on catalytic systems resulting in a loss of catalyst efficiency. ZDDP is known to provide a source of phosphorus that may cause significant problems with exhaust catalytic converters and oxygen sensors when the phosphorus from combusted oil forms an impermeable glaze that may mask precious metal catalytic sites. As a result there is pressure by the automakers to control and/or reduce the amount of phosphorus-containing compounds used in engine oils to facilitate longer converter and oxygen sensor life, and to reduce the manufacturer's initial costs of converters through lower precious metal content.

While a reduction in the phosphorus content of the lubricating oils may improve catalytic converter life or efficiency, the benefits of phosphorus additives for friction control and wear protection may not be conveniently matched by non-phosphorus containing additives. Accordingly, there is a competing need for additives and methods that enable protection of catalytic activity without significantly reducing a total phosphorus content of the lubricating oil compositions.

In one embodiment herein is presented a lubricated surface containing a lubricant composition including a base oil of lubricating viscosity, an amount of a phosphorus-containing compound, and an amount of at least one hydrocarbon soluble titanium compound. The titanium compound is effective to provide an aged catalyst temperature that converts at least fifty percent of exhaust gas hydrocarbons, carbon monoxide, and $NO_x$ that is lower than an aged catalyst temperature that converts at least fifty percent of exhaust gas hydrocarbons, carbon monoxide, and $NO_x$ of the lubricant composition devoid of the hydrocarbon soluble titanium compound.

In another embodiment, there is provided a vehicle having moving parts and containing a lubricant for lubricating the moving parts. The lubricant includes an oil of lubricating viscosity, at least one phosphorus-containing compound, and an amount of at least one hydrocarbon soluble titanium compound. The titanium compound is effective to provide an aged catalyst temperature that converts at least fifty percent of exhaust gas hydrocarbons, carbon monoxide, and $NO_x$ that is lower than an aged catalyst temperature that converts at least fifty percent of exhaust gas hydrocarbons, carbon monoxide, and $NO_x$ of the lubricant composition devoid of the hydrocarbon soluble titanium compound.

In yet another embodiment there is provided a fully formulated lubricant composition including a base oil component of lubricating viscosity, at least one phosphorus-containing compound, and an amount of hydrocarbon soluble titanium-containing agent. The titanium-containing agent is effective to provide an aged catalyst temperature that converts at least fifty percent of exhaust gas hydrocarbons, carbon monoxide, and NOx that is lower than an aged catalyst temperature that converts at least fifty percent of exhaust gas hydrocarbons, carbon monoxide, and NOx of the lubricant composition devoid of the hydrocarbon soluble titanium-containing agent. The titanium-containing agent is essentially devoid of sulfur and phosphorus atoms.

A further embodiment of the disclosure provides a method of reducing an aged exhaust catalyst temperature effective to convert at least fifty percent of exhaust gas hydrocarbons, carbon monoxide, and NOx. The method includes contacting the engine parts with a lubricant composition having a base oil of lubricating viscosity, at least one phosphorus-containing compound, and an amount of a hydrocarbon soluble titanium compound effective to provide an aged exhaust catalyst temperature that is lower than an aged exhaust catalyst temperature that converts at least fifty percent of exhaust gas hydrocarbons, carbon monoxide, and NOx of the lubricant composition devoid of the hydrocarbon soluble titanium compound.

As set forth briefly above, embodiments of the disclosure provide a hydrocarbon soluble titanium additive that may significantly improve exhaust catalyst performance despite the use of lubricant compositions containing phosphorus compounds that otherwise negatively impact exhaust catalyst performance over time. The additive may be mixed with an oleaginous fluid that is applied to a surface between moving parts. In other applications, the additive may be provided in a fully formulated lubricant composition. The additive is particularly directed to meeting the currently proposed GF-5 standards for passenger car motor oils and PC-10 standards for heavy duty diesel engine oil as well as future passenger car and diesel engine oil specifications. The additive may be particularly useful to enable vehicles to meet stringent 120,000 mile catalyst durability efficiency standards such as EPA Tier-II, BIN5.

It is to be understood that both the foregoing general description and the following detailed description are exemplary and explanatory only and are intended to provide further explanation of the embodiments disclosed and claimed.

BRIEF DESCRIPTION OF THE DRAWINGS

Further advantages of the exemplary embodiments may become apparent by reference to the detailed description of the exemplary embodiments when considered in conjunction with the following drawings illustrating one or more non-limiting aspects of thereof.

DETAILED DESCRIPTION OF EXEMPLARY EMBODIMENTS

Figure 1:
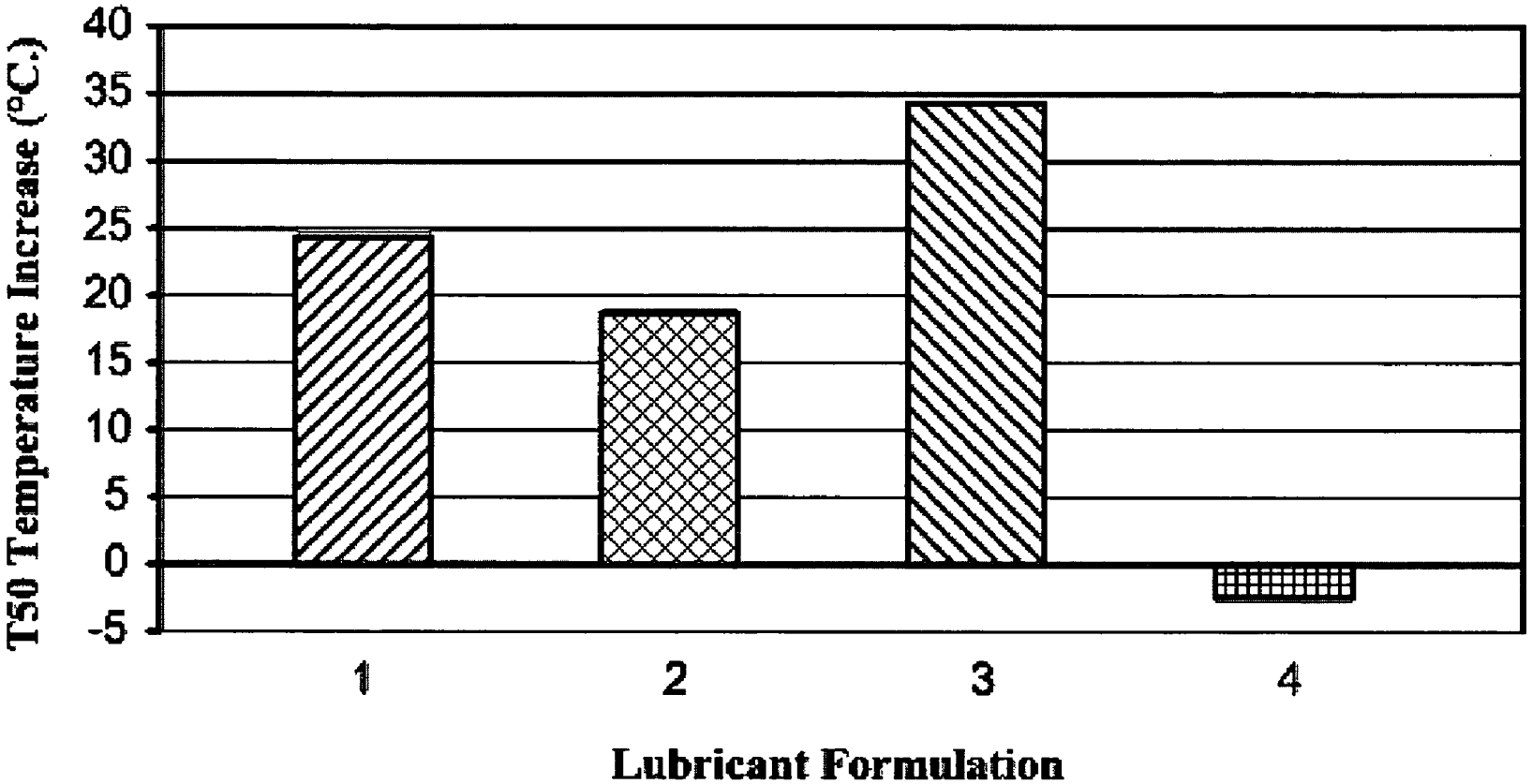
FIG. 1 is a graphical comparison of T50 temperature increase versus lubricant composition.

A primary component of the additives and concentrates provided for lubricant compositions described herein is a hydrocarbon soluble titanium compound. The term "hydrocarbon soluble" means that the compound is substantially suspended or dissolved in a hydrocarbon material, as by reaction or complexation of a reactive metal compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The hydrocarbon soluble titanium compounds suitable for use as a herein, for example as phosphorus retention agents are provided by a reaction product of a titanium alkoxide and an about $C_6$ to about $C_{25}$ carboxylic acid. The reaction product may be represented by the following formula:

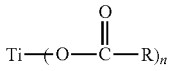

wherein n is an integer selected from 2, 3 and 4, and R is a hydrocarbyl group containing from about 5 to about 24 carbon atoms, or by the formula:

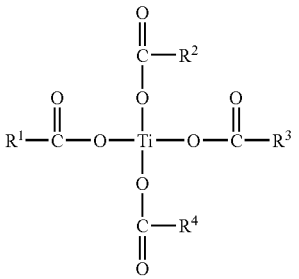

wherein each of $R^1$, $R^2$, $R^3$, and $R^4$ are the same or different and are selected from a hydrocarbyl group containing from about 5 to about 25 carbon atoms. Compounds of the foregoing formulas are essentially devoid of phosphorous and sulfur.

In an embodiment, the hydrocarbon soluble titanium compound may be substantially or essentially devoid or free of sulfur and phosphorus atoms such that a lubricant or formulated lubricant package comprising the hydrocarbon soluble titanium compound contains about 0.7 wt % or less sulfur and about 0.12 wt % or less phosphorus.

In another embodiment, the hydrocarbon soluble titanium compound may be substantially free of active sulfur. "Active" sulfur is sulfur which is not fully oxidized. Active sulfur further oxidizes and becomes more acidic in the oil upon use.

In yet another embodiment, the hydrocarbon soluble titanium compound may be substantially free of all sulfur. In a further embodiment, the hydrocarbon soluble titanium compound may be substantially free of all phosphorus.

In a still further embodiment, the hydrocarbon soluble titanium compound may be substantially free of all sulfur and phosphorus. For example, the base oil in which the titanium compound may be dissolved in may contain relatively small amounts of sulfur, such as in one embodiment, less than about 0.5 wt % and in another embodiment, about 0.03 wt % or less sulfur (e.g., for Group II base oils), and in a still further embodiment, the amount of sulfur and/or phosphorus may be limited in the base oil to an amount which permits the finished oil to meet the appropriate motor oil sulfur and/or phosphorus specifications in effect at a given time.

Examples of titanium/carboxylic acid products include, but are not limited to, titanium reaction products with acids selected from the group consisting essentially of caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like. Methods for making such titanium/carboxylic acid products are described, for example, in U.S. Pat. No. 5,260,466, the disclosure of which is incorporated herein by reference.

The hydrocarbon soluble titanium compounds of the embodiments described herein are advantageously incorporated into lubricating compositions. Accordingly, the hydrocarbon soluble titanium compounds may be added directly to the lubricating oil composition. In one embodiment, however, hydrocarbon soluble titanium compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a titanium additive concentrate. The titanium additive concentrates usually contain from about 0% to about 99% by weight diluent oil.

In the preparation of lubricating oil formulations it is common practice to introduce the titanium additive concentrates in the form of 1 to 99 wt. % active ingredient concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing 0.01 to 50 parts by weight of lubricating oil per part by weight of the DI package to form finished lubricants, e.g. crankcase motor oils. Suitable DI packages are described for example in U.S. Pat. Nos. 5,204,012 and 6,034,040 for example. Among the types of additives included in the DI additive package are detergents, dispersants, antiwear agents, friction modifiers, seal swell agents, antioxidants, foam inhibitors, lubricity agents, rust inhibitors, corrosion inhibitors, demulsifiers, viscosity index improvers, and the like. Several of these components are well known to those skilled in the art and are preferably used in conventional amounts with the additives and compositions described herein.

In another embodiment, the titanium additive concentrates may be top treated into a fully formulated motor oil or finished lubricant. The purpose of titanium additive concentrates and DI package, of course, is to make the handling of the various materials less difficult and awkward as well as to facilitate solution or dispersion in the final blend. A representative DI package may contain, dispersants, antioxidants, detergents, antiwear agents, antifoam agents, pour point depressants, and optionally VI improvers and seal swell agents.

Embodiments described herein provide lubricating oils and lubricant formulations in which the concentration of the hydrocarbon soluble titanium compound is relatively low, providing from about 1 to about 1500 parts per million (ppm) titanium in terms of elemental titanium in the finished lubricant composition. In one embodiment, the titanium compound is present in the lubricating oil compositions in an amount sufficient to provide from about 50 to about 1000 ppm titanium and in a further embodiment from about 50 to about 500 ppm titanium.

Lubricant compositions made with the hydrocarbon soluble titanium, additives described above are used in a wide variety of applications. For compression ignition engines and spark ignition engines, it is preferred that the lubricant compositions meet or exceed published ILSAC GF-4 or API-CJ-4 standards. Lubricant compositions according to the foregoing ILSAC GF-4 or API-CJ-4 standards include a base oil, the DI additive package, and/or a VI improver to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

Phosphorus-Containing Compounds

Another component of the lubricant composition is a phosphorus-containing compound such as ZDDP. Suitable ZDDPs may be prepared from specific amounts of primary and/or secondary alcohols. For example, the alcohols may be combined in a ratio of from about 100:0 to about 0:100 primary-to-secondary alcohols. As an even further example, the alcohols may be combined in a ratio of about 60:40 primary-to-secondary alcohols. An example of a suitable ZDDP may comprise the reaction product obtained by combining: (i) about 50 to about 100 mol % of about $C_1$ to about $C_{18}$ primary alcohol; (ii) up to about 50 mol % of about $C_3$ to $C_{18}$ is secondary alcohol; (iii) a phosphorus-containing component; and (iv) a zinc-containing component. As a further example, the primary alcohol may be a mixture of from about $C_1$ to about $C_{18}$ alcohols. As an even further example, the primary alcohol may be a mixture of a $C_4$ and a $C_8$ alcohol. The secondary alcohol may also be a mixture of alcohols. As an example, the secondary alcohol may comprise a $C_3$ alcohol. The alcohols may contain any of branched, cyclic, or straight chains. The ZDDP may comprise the combination of about 60 mol % primary alcohol and about 40 mol % secondary alcohol. In the alternative, the ZDDP may comprise 100 mol % secondary alcohols, or 100 mol % primary alcohols.

The phosphorus-containing component of the phosphorus-containing compound may comprise any suitable phosphorus-containing component such as, but not limited to a phosphorus sulfide. Suitable phosphorus sulfides may include phosphorus pentasulfide or tetraphosphorus trisulfide.

The zinc-containing component may comprise any suitable zinc-containing component such as, but not limited to zinc oxide, zinc hydroxide, zinc carbonate, zinc propylate, zinc chloride, zinc propionate, or zinc acetate.

The reaction product may comprise a resulting mixture, component, or mixture of components. The reaction product may or may not include unreacted reactants, chemically bonded components, products, or polar bonded components.

The ZDDP or ash-containing phosphorus compound, may be present in an amount sufficient to contribute from about 0.02 wt % to about 0.15 wt % phosphorus in the lubricant composition.

In addition to, or in the alternative, an ash-free phosphorus compound may be included in a mixture of phosphorus-containing compounds. The ash-free phosphorus compound may be selected from an organic ester of phosphoric acid, phosphorous acid, or an amine salt thereof. For example, the ash-free phosphorus-containing compound may include one or more of a dihydrocarbyl phosphite, a trihydrocarbyl phosphite, a monohydrocarbyl phosphate, a dihydrocarbyl phosphate, a trihydrocarbyl phosphate, any sulfur analogs thereof, and any amine salts thereof. As a further example, the ash-free phosphorus-containing compound may include at least one or a mixture of monohydrocarbyl- and dihydrocarbyl phosphate amine salt, for example, an amyl acid phosphate salt may be a mixture of monoamylacid phosphate salt and diamylacid phosphate salt.

A weight ratio based on phosphorus from the ash-containing phosphorus compound and phosphorus from the ash-free phosphorus compound in the lubricating oil composition may range from about 3:1 to about 1:3. Another mixture of phosphorus compounds that may be used may include from about 0.5 to about 2.0 parts by weight of phosphorus from an ash-containing phosphorus compound to about 1 part weight of phosphorus from an ash-free phosphorus compound. Yet another mixture of phosphorus compounds may include about equal parts by weight of phosphorus from the ash-containing phosphorus compound and phosphorus from the ash-free phosphorus compound. Examples of mixtures of phosphorus from the ash-containing and phosphorus from the ash-free phosphorus compounds are provided in the following table.

The mixture of phosphorus-containing compounds in the lubricating oil formulation may be present in an amount sufficient to provide from about 300 to about 1200 parts per million by weight of total phosphorus in the lubricating oil formulation. As a further example, the mixture of phosphorus-containing compounds may be present in an amount sufficient to provide from about 500 to about 800 parts per million by weight of total phosphorus in the lubrication oil formulation.

The phosphorus-containing compound and titanium compound mixture disclosed herein is used in combination with other additives. The additives are typically blended into the base oil in an amount that enables that additive to provide its desired function. Representative effective amounts of the phosphorus-containing and titanium compound mixtures and additives, when used in crankcase lubricants, are listed in Table 1 below. All the values listed are stated as weight percent active ingredient.

TABLE 1

| Component | Wt. % (Broad) | Wt. % (Typical) |
|---|---|---|
| Dispersant | 0.5-10.0 | 1.0-5.0 |
| Antioxidant system | 0-5.0 | 0.01-3.0 |
| Metal Detergents | 0.1-15.0 | 0.2-8.0 |

TABLE 1-continued

| Component | Wt. % (Broad) | Wt. % (Typical) |
|---|---|---|
| Corrosion Inhibitor | 0-5.0 | 0-2.0 |
| Metal dihydrocarbyl dithiophosphate | 0.1-6.0 | 0.1-4.0 |
| Ash-free amine phosphate salt | 0.1-6.0 | 0.1-4.0 |
| Antifoaming agent | 0-5.0 | 0.001-0.15 |
| Titanium Compound | 0-5.0 | 0-2.0 |
| Supplemental antiwear agents | 0-1.0 | 0-0.8 |
| Pour point depressant | 0.01-5.0 | 0.01-1.5 |
| Viscosity modifier | 0.01-20.00 | 0.25-10.0 |
| Supplemental friction modifier | 0-2.0 | 0.1-1.0 |
| Base oil | Balance | Balance |
| Total | 100 | 100 |

Dispersant Components

Dispersants contained in the DI package include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used in combination with the hydrocarbon soluble titanium compounds, include sterically hindered phenols as described in U.S Publication No. 2004/0266630, diarylamines, alkylated phenothiazines, sulfurized compounds, and ashless dialkyldithiocarbamates.

Diarylamine antioxidants include, but are not limited to diarylamines having the formula:

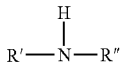

wherein R' and R" each independently represents a substituted or unsubstituted aryl group having from 6 to 30 carbon atoms.

Another class of aminic antioxidants includes phenothiazine or alkylated phenothiazine having the chemical formula:

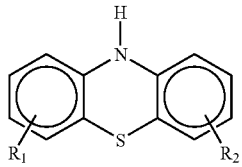

wherein $R_1$ is a linear or branched $C_1$ to $C_{24}$ alkyl, aryl, heteroalkyl or alkylaryl group and $R_2$ is hydrogen or a linear or branched $C_1$-$C_{24}$ alkyl, heteroalkyl, or alkylaryl group.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. Examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Organomolybdenum containing compounds used as friction modifiers may also exhibit antioxidant functionality. U.S. Pat. No. 6,797,677 describes a combination of organomolybdenum compound, alkylphenothizine and alkyldiphenylamines for use in finished lubricant formulations. Examples of suitable molybdenum containing friction modifiers are described below under friction modifiers.

Friction Modifier Components

Examples of sulfur- and phosphorus-free organomolybdenum compounds include compounds described in the following patents: U.S. Pat. Nos. 4,259,195; 4,261,843; 4,164,473; 4,266,945; 4,889,647; 5,137,647; 4,692,256; 5,412,130; 6,509,303; and 6,528,463.

Examples of sulfur-containing organomolybdenum compounds include compounds described in the following patents: U.S. Pat. Nos. 3,509,051; 3,356,702; 4,098,705; 4,178,258; 4,263,152; 4,265,773; 4,272,387; 4,285,822; 4,369,119; 4,395,343; 4,283,295; 4,362,633; 4,402,840; 4,466,901; 4,765,918; 4,966,719; 4,978,464; 4,990,271; 4,995,996; 6,232,276; 6,103,674; and 6,117,826.

Glycerides may also be used alone or in combination with other friction modifiers. Suitable glycerides include glycerides of the formula:

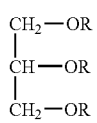

wherein each R is independently selected from the group consisting of H and C(O)R' where R' may be a saturated or an unsaturated alkyl group having from 3 to 23 carbon atoms.

Other Additives

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Seal swell agents, as described, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The hydrocarbon soluble titanium additives may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the titanium compound.

Base Oils

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

The following examples are given for the purpose of exemplifying aspects of the embodiments and are not intended to limit the embodiments in any way.

Example 1

Titanium Neodecanoate

Neodecanoic acid (600 grams) was placed into a reaction vessel equipped with a condenser, Dean-stark trap, thermometer, thermocouple, and a gas inlet. Nitrogen gas was bubbled into the acid. Titanium isopropoxide (245 grams) was slowly added to the reaction vessel with vigorous stirring. The reactants were heated to 140° C. and stirred for one hour. Overheads and condensate from the reaction were collected in the trap. A subatmospheric pressure was applied to the reaction vessel and the reactants were stirred for an additional two hours until the reaction was complete. Analysis of the product indicated that the product had a kinematic viscosity of 14.3 cSt at 100° C. and a titanium content of 6.4 percent by weight.

Catalyst performance may be determined before and after an aging process by the performance of a Conversion Efficiency (CE) test. For the purposes of this disclosure, an "aged catalyst" is any catalyst that has previously been exposed to exhaust gases containing exhaust gas components to be converted. For example, a catalyst may be exposed to an amount of exhaust gases sufficient to simulate operation of a vehicle containing the catalyst for about 17,000 to about 20,000 miles. In the CE evaluation the engine is operated at a steady-state condition while the exhaust gas temperature is controlled to maintain a steady catalyst inlet temperature. Exhaust inlet temperature is stepped up in 15° C. intervals from 200° C. to 440° C. while hydrocarbon (HC), carbon monoxide (CO), and oxides of nitrogen (NOx) emissions are measured through probes inserted before and after the catalyst. Curves may be constructed from the data to provide the "T50" value or temperature where 50% conversion occurs for each emission type. By comparing the T50 values before and after catalyst aging the relative amount of catalyst degradation may be determined and compared to one another. The aging process typically results in an increase in all of the T50 values, except when the oil contains no phosphorus-containing additives. Thermal deactivation of the catalyst using extreme temperatures is avoided so that the primary deactivation that occurs during the performance test is chemical deactivation.

FIG. 1 illustrates a performance comparison for several 5W-30 multigrade lubricant formulations. The T50 temperature for converting fifty percent of the hydrocarbons (HC), carbon monoxide (CO), and nitrous oxides ($NO_x$) were determined for exhaust catalysts from engines containing the lubricant formulations in Table 2. The additive metal content of the formulations are contained in Table 3, and the T50 data for the formulations are contained in Table 4.

The HC and CO in the exhaust gases are converted by the catalyst through an oxidation reaction to $CO_2$ and $H_2O$. $NO_x$ in the exhaust gases is converted by the catalyst through a reduction reaction to $N_2$ and $N_2O$. Since the volume of catalyst and residence time of exhaust gases in the catalyst are the same for each performance test, the resulting T50 temperatures are relative comparisons for each of the indicated formulations.

In the following table, the metal dihydrocarbyl dithiophosphate of Formula 1 was derived from primary alcohols. The metal dihydrocarbyl dithiophosphate of Formulas 2 and 4 were derived from methyl-isobutyl carbinol (MIBC). The metal dihydrocarbyl dithiophosphate of Formula 3 was derived from conventional secondary alcohols.

TABLE 2

| Component | Formula 1 | Formula 2 | Formula 3 | Formula 4 |
|---|---|---|---|---|
| DI Package Components | 18.45 | 18.45 | 18.45 | 18.45 |
| Metal dihydrocarbyl dithiophosphate (ZDDP) | 1.16 | 1.20 | 1.20 | 1.20 |
| Titanium Compound | 0.00 | 0.00 | 0.00 | 0.15 |
| Base oil | 80.39 | 80.35 | 80.35 | 80.20 |
| Total | 100 | 100 | 100 | 100 |

TABLE 3

| Formulation | Calcium (ppm) | Phosphorus (ppm) | Titanium (ppm) | Zinc (ppm) | Boron (ppm) |
|---|---|---|---|---|---|
| 1 | 1700 | 928 | 0 | 1100 | 247 |
| 2 | 1700 | 920 | 0 | 1070 | 229 |
| 3 | 1690 | 920 | 0 | 1050 | 235 |
| 4 | 1690 | 920 | 97 | 1050 | 235 |

TABLE 4

| Formulation | HC T50 Change (° C.) | CO T50 Change (° C.) | NOx T50 Change (° C.) | Average T50 Change (° C.) |
|---|---|---|---|---|
| 1 | 15 | 30 | 29 | 24.7 |
| 2 | 15 | 22 | 22 | 19.7 |
| 3 | 34 | 36 | 35 | 35.0 |
| 4 | −3 | −3 | −1 | −2.3 |

As shown by the results in Table 4, a formulation containing 97 ppm titanium (Formula 4) provided by a hydrocarbon soluble titanium compound in combination with the MIBC derived ZDDP has a substantially lower change in the T50 temperatures for hydrocarbons (HC), nitrous oxides (NOx) and carbon monoxide (CO) than any of the other formulations thereby providing improved aged catalyst performance over formulations 1-3. Formula 4 is thus expected to provide improved catalyst performance compared to formulations 1-3 that are devoid of the titanium compound. Without being limited to theoretical considerations, it is believed that the titanium compound is effective to reduce chemical deactivation of the catalyst over time.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricated surface of a device containing an exhaust catalyst for an engine, the surface comprising a lubricant composition including a base oil of lubricating viscosity, at least one ash-free phosphorus compound, at least one zinc dialkyl dithiophosphate (ZDDP) compound derived from methyl-isobutyl carbinol (MIBC), and an amount of at least one hydrocarbon soluble titanium compound that is effective to provide an aged catalyst temperature that converts at least fifty percent of exhaust gas hydrocarbons, carbon monoxide, and NOx that is lower than an aged catalyst temperature that converts at least fifty percent of exhaust gas hydrocarbons, carbon monoxide, and NOx of the lubricant composition devoid of the hydrocarbon soluble titanium compound, wherein a weight ratio on a phosphorus basis of the ZDDP compound to the ash-free phosphorus compound ranges from about 3:1 to about 1:3.

2. The lubricated surface of claim 1, wherein the lubricated surface comprises an internal surface or component of an engine selected from the group consisting of internal combustion engines and compression ignition engines.

3. The lubricated surface of claim 1, wherein the amount of hydrocarbon soluble titanium compound provides an amount of titanium ranging from about 50 to about 1000 ppm in the lubricant composition.

4. The lubricated surface of claim 1, wherein the amount of hydrocarbon soluble titanium compound provides an amount of titanium ranging from about 100 to about 500 ppm in the lubricant composition.

5. The lubricated surface of claim 1, wherein the hydrocarbon soluble titanium compound comprises a reaction product of titanium isopropoxide and neodecanoic acid.

6. A vehicle having an engine and containing a lubricant for lubricating the engine, the lubricant comprising an oil of lubricating viscosity, at least one ash-free phosphorus compound, at least one zinc dialkyl dithiophosphate (ZDDP) compound derived from methyl-isobutyl carbinol (MIBC), and an amount of at least one hydrocarbon soluble titanium compound effective to provide an aged catalyst temperature that converts at least fifty percent of exhaust gas hydrocarbons, carbon monoxide, and NOx that is lower than an aged catalyst temperature that converts at least fifty percent of exhaust gas hydrocarbons, carbon monoxide, and NOx of the lubricant composition devoid of the hydrocarbon soluble titanium compound, wherein a weight ratio on a phosphorus basis of ZDDP compound to the ash-free phosphorus compound ranges from about 3:1 to about 1:3.

7. The vehicle of claim 6, wherein the hydrocarbon soluble titanium compound comprises a reaction product of titanium isopropoxide and neodecanoic acid.

8. The vehicle of claim 6, wherein the moving parts comprise a heavy duty diesel engine.

9. The vehicle of claim 6, wherein the amount of hydrocarbon soluble titanium compound provides an amount of titanium ranging from about 50 to about 1000 ppm in the lubricant composition.

10. The vehicle of claim 6, wherein the amount of hydrocarbon soluble titanium compound provides an amount of titanium ranging from about 100 to about 500 ppm in the lubricant composition.

11. A fully formulated engine lubricant composition comprising a base oil component of lubricating viscosity, at least one ash-free phosphorus compound, at least one zinc dialkyl dithiophosphate (ZDDP) compound derived from methyl-isobutyl carbinol (MIBC), and an amount of hydrocarbon soluble titanium-containing agent effective to provide an aged catalyst temperature that converts at least fifty percent of exhaust gas hydrocarbons, carbon monoxide, and NOx that is lower than an aged catalyst temperature that converts at least fifty percent of exhaust gas hydrocarbons, carbon monoxide, and NOx of the lubricant composition devoid of the hydrocarbon soluble titanium-containing agent, wherein the titanium-containing agent is essentially devoid of sulfur and phosphorus atoms, wherein a weight ratio on a phosphorus basis of the ash-containing phosphorus compound to the ash-free phosphorus compound ranges from about 3:1 to about 1:3.

12. The lubricant composition of claim 11, wherein the lubricant composition comprises a low ash, low sulfur, and low phosphorus lubricant composition suitable for compression ignition engines.

13. The lubricant composition of claim 11, wherein the amount of hydrocarbon soluble titanium-containing agent provides from about 50 to about 1000 parts per million titanium in the lubricant composition.

14. The lubricant composition of claim 11, wherein the amount of hydrocarbon soluble titanium compound provides an amount of titanium ranging from about 100 to about 500 ppm in the lubricant composition.

15. A method of reducing an aged exhaust catalyst temperature for an engine effective to convert at least fifty percent of exhaust gas hydrocarbons, carbon monoxide, and NOx, comprising contacting the engine parts with a lubricant composition comprising a base oil of lubricating viscosity, at least one ash-free phosphorus compound, at least one zinc dialkyl dithiophosphate (ZDDP) compound derived from methyl-isobutyl carbinol (MIBC), and an amount of a hydrocarbon soluble titanium compound effective to provide an aged exhaust catalyst temperature that is lower than an aged exhaust catalyst temperature that converts at least fifty percent of exhaust gas hydrocarbons, carbon monoxide, and NOx of the lubricant composition devoid of the hydrocarbon soluble titanium compound, wherein a weight ratio on a phosphorus basis of the ZDDP compound to the ash-free phosphorus compound ranges from about 3:1 to about 1:3.

16. The method of claim 15, wherein the engine comprises a heavy duty diesel engine.

17. The method of claim 15, wherein, wherein the hydrocarbon soluble titanium-containing agent comprises a reaction product of titanium isopropoxide and neodecanoic acid.

18. The method of claim 15, wherein the amount of hydrocarbon soluble titanium-containing agent provides from about 50 to about 1000 parts per million titanium in the lubricant composition.

19. The method of claim 15, wherein the amount of hydrocarbon soluble titanium compound provides an amount of titanium ranging from about 100 to about 500 ppm in the lubricant composition.

20. An additive concentrate for a lubricant composition used to lubricate an engine containing an exhaust catalyst, the additive concentrate comprising, at least one ash-free phosphorus compound, at least one zinc dialkyl dithiophosphate (ZDDP) compound derived from methyl-isobutyl carbinol (MIBC), and an amount of hydrocarbon soluble titanium-containing agent effective to provide an aged catalyst temperature that converts at least fifty percent of exhaust gas hydrocarbons, carbon monoxide, and NOx that is lower than an aged catalyst temperature that converts at least fifty percent of exhaust gas hydrocarbons, carbon monoxide, and NOx of the lubricant composition devoid of the hydrocarbon soluble titanium-containing agent, wherein the titanium-containing agent is essentially devoid of sulfur and phosphorus atoms, wherein a weight ratio on a phosphorus basis of the ZDDP compound to the ash-free phosphorus compound ranges from about 3:1 to about 1:3.

21. The concentrate of claim 20, wherein the amount of hydrocarbon soluble titanium compound provides an amount of titanium ranging from about 50 to about 1000 ppm in the lubricant composition.

22. The concentrate of claim 20, wherein the amount of hydrocarbon soluble titanium compound provides an amount of titanium ranging from about 100 to about 500 ppm in the lubricant composition.

23. The concentrate of claim 20, wherein the amount of hydrocarbon soluble titanium compound provides an amount of titanium ranging from about 50 to about 300 ppm in the lubricant composition.

24. The concentrate of claim 20, wherein the hydrocarbon soluble titanium compound comprises a reaction product of titanium isopropoxide and neodecanoic acid.

25. The lubricated surface of claim 1, wherein the hydrocarbon soluble titanium compound comprises a reaction product of titanium alkoxide and a $C_6$ to $C_{25}$ carboxylic acid.

* * * * *